US006699358B1

(12) United States Patent
Evans et al.

(10) Patent No.: US 6,699,358 B1
(45) Date of Patent: Mar. 2, 2004

(54) METHOD FOR BRIGHTENING CHEMICAL PULP WITH HYDROGEN PEROXIDE USING A MAGNESIUM COMPOUND IN SILICATE SOLUTION

(75) Inventors: Timothy D. Evans, Oakville (CA); Raymond C. Francis, Dewitt, NY (US)

(73) Assignees: National Silicates Partnership, Etobicoke (CA); Research Foundation of State University of New York, Albany, NY (US)

( * ) Notice: Subject to any disclaimer, the term of this patent is extended or adjusted under 35 U.S.C. 154(b) by 0 days.

(21) Appl. No.: 09/700,475

(22) PCT Filed: May 15, 1998

(86) PCT No.: PCT/US98/10070

§ 371 (c)(1),
(2), (4) Date: Jan. 11, 2001

(87) PCT Pub. No.: WO99/60201

PCT Pub. Date: Nov. 25, 1999

(51) Int. Cl.[7] ..... D21C 9/147; D21C 9/16

(52) U.S. Cl. ..... 162/65; 162/78; 162/80; 162/90

(58) Field of Search ..... 162/65, 78, 80, 162/90, 82

(56) References Cited

U.S. PATENT DOCUMENTS

| | | | | |
|---|---|---|---|---|
| 4,915,785 | A | 4/1990 | Siminoski et al. | |
| 5,571,377 | A | * 11/1996 | Tibbling et al. | 162/78 |

FOREIGN PATENT DOCUMENTS

| | | |
|---|---|---|
| AU | 567787 | 7/1985 |
| EP | 0 148 712 | 7/1985 |
| EP | 0 677 124 | 10/1995 |
| WO | 94/10374 | 5/1994 |

OTHER PUBLICATIONS

Robitaille et al, "Hydrogen peroxide: A versatile bleaching agent"; Pulp & Paper Canada, Dec. 1988, pp. 167–170.*

Singh, "The Bleaching of Pulp"; Tappi Press, Atlanta, 1979.*

Burton, J . T., "An Investigation into the Roles of Sodium Silicate and Epsom Salt in Hydrogent Peroxide Bleaching," *Journal of Pulp and Paper Science*, vol. 12, No. 4, Jul. 1986, pp. 395–399.

Froass, William C. et al., "Effects of recycling peroxide liquor on brightness of mechanical pulp," *Tappi Journal*, vol. 76, No. 11, pp. 111–119.

Froass, W. C. et al., "The Interactions of Calcium, Magnesium and Silicate Ions Under Alkaline Conditions," *Journal of Pulp and Paper Science*, Bol. 23, No. 7, Jul. 1997, pp. 3318–3325.

Orlowski, Gerard et al., "Silicate Scale Management Strategy at Millar Western; Whitecourt and Meadow Lake Mills," 1996 Pulping Conference, TAPPI Proceedings, pp. 341–348.

Basta, J. et al., "Metal Management, Mechanical Versus Chemical Pulp Bleaching," 1996 Pulping Conference, TAPPI Proceedings, pp. 23–28.

Anderson, J. R. et al., "Process Characterization of High Temperature Hydrogen Peroxide Bleaching: Caustic Addition," 83rd Annual Meeting, Technical Section CPPA, pp. B175–B184.

McDonough, Tom J., "Simultaneous brightening and strengthening of GW, TMP and high yield bisulphite pulp: A laboratory investigation favors chlorine dioxide oxidation, followed by an alkaline peroxide step," *Pulp & Paper Canada*, vol. 78, No. 12, Dec. 1977, pp. 63–72.

Francis, Dr. R. C., "Interim Report on Graduate Research Fellowship in Silicates Chemistry," submitted to National Silicates Ltd., Toronto, Ontario, Canada, Feb. 7, 1997.

Lidén, Jan et al., "Solid Solution Formation Between $Mg^{2+}$, $Fe^{2+}$ and $Mn^{2+}$ in Hydroxide, Carbonate, and Silicate Solid Phases," 1997 TAPPI Minimum Effluent Mills Symposium, San Francisco, CA, Oct. 23–24, 1997, pp. 45–50.

Copy of International Search Report dated Jun. 7, 2000.

R.C. Francis, S.K. Bose, D.H. Pugliese, and A.F. Brown, "Yield After $O_2$ and P/O Bleaching of Soft–Wood Kraft Pulps," Empire State Paper Research Associates (ESPRA) Research Report, 108, pp. 91–97, May 19, 1998.

* cited by examiner

*Primary Examiner*—Steve Alvo
(74) *Attorney, Agent, or Firm*—RatnerPrestia

(57) ABSTRACT

A method for brightening chemical pulps with less than 18% lignin utilizing a magnesium compound in a sodium silicate solution to form a higher percentage of high molecular weight silicates. Such high molecular weight silicates preferentially adsorb transition metal impurities, which, if left in solution, would tend to decompose hydrogen peroxide and organic peroxides. Hydrogen peroxide is added to peroxide and peroxide/oxygen stages, while it is generated, along with organic peroxides during an oxygen stage.

2 Claims, No Drawings

METHOD FOR BRIGHTENING CHEMICAL PULP WITH HYDROGEN PEROXIDE USING A MAGNESIUM COMPOUND IN SILICATE SOLUTION

FIELD OF THE INVENTION

The present invention pertains to the brightening of chemical pulps and deinked, mixed office waste pulps, and particularly to the brightening of such pulps in a peroxide or peroxide/oxygen stage of brightening.

BACKGROUND OF THE INVENTION

The process of making paper from wood involves the following general stages: (1) bark removal; (2) wood chipping; (3) pulping; (4) brightening; and (5) forming a sheet of paper on a machine. During pulping, wood is reduced to its fibrous state, with a portion of the lignin content in the wood being removed. Pulps can be divided into two main categories—chemical and mechanical pulps—depending on how they are made from wood. Chemical pulping involves the use of chemical reagents to effect a separation of the cellulose fibers from the other wood components, such as lignin and other extraneous compounds. In the process, most of the hemicelluloses are also dissolved. Thus, the yield for chemical pulping is typically 40–50% on wood.

Mechanical pulping involves the reduction of wood to the fibrous state by mechanical means, such as by grinding logs into pulp by large revolving grindstones. These pulps are called "mechanical" because a significant amount of mechanical energy (grinding or refining) is required to break down the wood chips. Except for a few water soluble components, all of the constituents of the wood are present in the ground wood pulp. Thus, mechanical pulps are characterized by their high yield and high lignin content. For example, although chemical pulps contain only about 5% lignin (weight basis on pulp) after pulping, mechanical pulps typically contain greater than 20% lignin for hardwoods and 25% for softwoods after pulping.

In general, the brightening of chemical and mechanical pulps occur by different mechanisms. This difference in approach is due, in part, to the difference in lignin content between the chemical and mechanical pulps and to the different nature of the lignin in chemical pulps than that in mechanical pulps. The remaining lignin in chemical pulps is typically more difficult to degrade than the majority of the lignin remaining in mechanical pulps. For example, chemical pulps, such as kraft pulps, are more difficult to brighten by $H_2O_2$. Thus, instead of the 60° C. bleaching temperature used for mechanical pulps, values in the range of 110° C. are used for kraft pulps (which use sodium hydroxide and sodium sulfide as the primary chemical reagents). As another example of the differences in brightening the two different types of pulp, chlorine dioxide ($ClO_2$), a stable free radical, is involved in the brightening of more than 90% of bleached kraft pulp produced in the U.S.A. per year. On the other hand, it has been reported that chlorine dioxide actually darkens mechanical pulps. In sum, results obtained with mechanical pulps cannot be considered as being predictive for chemical pulps.

Various additives have been proposed to improve the brightening process of mechanical pulps or mixed chemical/mechanical pulps having a high lignin content (i.e., above 20% by weight on pulp). Sodium silicate is widely used for hydrogen peroxide brightening of such pulps. It acts as a peroxide stabilizer and as a buffer during the bleaching reaction. Sodium silicate, in combination with a small dose of $MgSO_4$, has long been known to improve the brightness of mechanical pulps. The two chemicals are known to form an intermediate that adsorbs or complexes transition metal species which would otherwise undesirably catalyze the decomposition of $H_2O_2$. The two chemical combination is widely used in installations that bleach mechanical pulps. When magnesium sulfate has been used for such pulps, however, no increase in brightness has been observed when the $MgSO_4.7H_2O$ dose is increased above 0.05% on mechanical pulp (2.0 mmoles/kg). Accordingly, previous researchers had no need to add more magnesium to their pulps.

Turning to the brightening of chemical pulps, some results have suggested that silicate has a negative effect on $H_2O_2$ bleaching of kraft pulps. In some cases, the inclusion of silicate lowered the brightness by 4.6 percentage points (measured as % GE brightness in accordance with TAPPI Standard T452 om-92) and by 2–7 percentage points.

In peroxide brightening of mechanical pulps, the key is nucleophilic degradation of carbonyl compounds in the native lignin without the oxidation of phenols to o- and p-quinones, as shown below in reactions [A] and [B], respectively.

[A]

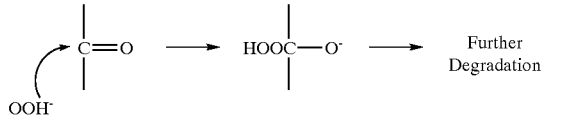

[B]

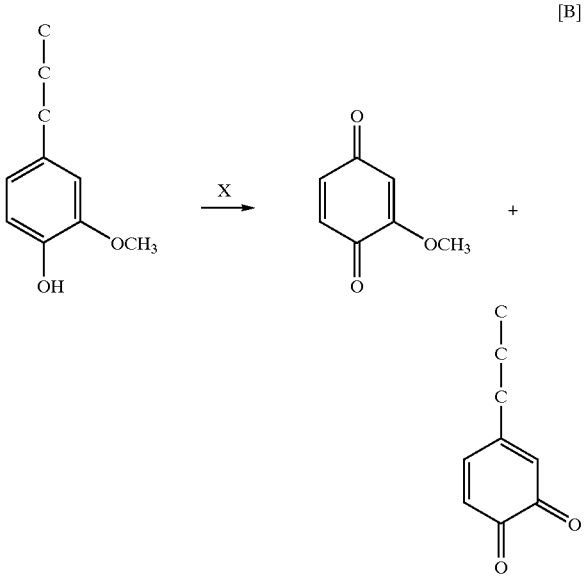

Reaction [A] is the desirable degradation of carbonyl compounds by the perhydroxyl anion, $OOH^-$. This reaction breaks down the carbonyl compounds, which absorb light in the visible range, to a more soluble form to be washed away by water. On the other hand, reaction [B] represents the undesirable formation of o- and p-quinones, which are less soluble in water and also absorb light in the visible range.

The perhydroxyl anion is generated by the dissociation of $H_2O_2$ as shown by equation [1] below. Mild conditions have to be used to prevent the oxidation of phenolics.

$$H_2O_2+H_2O \leftrightarrow H_3O^+ + OOH^- \quad pKa=11.6 \qquad [1]$$

Mechanical pulps contain high concentrations of lignin and extractives whose negatively charged sites may complex transition metals. Also, some transition metal catalysis can be tolerated because lignin is a very good radical scavenger. It will scavenge the superoxide anion ($.O_2^-$) and prevent wasteful decomposition to $O_2$ (equation [2]).

$$.O_2^- + M^{(m+1)+} \rightarrow O_2 + M^{n+} \quad [2]$$

Actually, $.O_2^-$ is nucleophilic and its reaction with lignin is reported to result in increased brightness. In sum, transition metal deactivation by magnesium silicates is important but not critical to the brightening of mechanical pulps.

Unlike softwood mechanical pulps which typically contain about 25% lignin (by weight on pulp), chemical pulps enter the final brightening stage with typically less than 2% lignin, which is typically colored and very difficult to oxidize. The approach with $H_2O_2$ is nucleophilic degradation by $OOH^-$. However, equation [2] becomes favorable because there is not a large amount of reactive lignin to scavenge $.O_2^-$. Equation [2], in conjunction with equations [3] and [4], results in wasteful decomposition of $H_2O_2$.

$$M^{n+} + H_2O_2 \rightarrow M^{(m+1)+} + .OH + {}^-OH \quad [3]$$

$$.OH + {}^-OOH \rightarrow .O_2^- + H_2O \quad [4]$$

Equation [3] is favorable for Cu(I) and Fe(II) but not for Mn(II). A more probable mechanism for Mn(II) is outlined below. The subscripted s indicates soluble Mn(IV) and Mn(III).

$$Mn^{2+}_{(s)} + H_2O_2 \rightarrow Mn^{4+}_{(s)} + 2OH^-$$

$$Mn^{4+}_{(s)} + {}^-OOH \rightarrow Mn^{3+}_{(s)} + H^+ + .O_2^-$$

$$Mn^{3+}_{(s)} + {}^-OOH \rightarrow Mn^{2+}_{(s)} + H^+ + .O_2^-$$

Lignin degradation by $OOH^-$ requires a high temperature because of the unreactive nature of the lignin in chemical pulps. At 110° C., transition metal deactivation is extremely important.

With respect to $O_2$ delignification, a simple and well-accepted scheme for free radical generation is provided below. RH is a reactive structure in the solution phase.

$$RH + O_2 \rightarrow R. + .OOH \quad [5]$$

$$.OOH + H. \rightarrow HOOH\ (H_2O_2) \quad [6]$$

(Abstraction of H atom from lignin)

$$R. + O_2 \rightarrow ROO. \quad [7]$$

$$ROO. + H. \rightarrow ROOH \quad [8]$$

$H_2O_2$ and ROOH will be affected by transition metals in the same manner as in a peroxide/oxygen stage. Thus, the oxygen stage is similar to the peroxide/oxygen stage in that they both involve heterolytic (i.e., ionic) reactions and homolytic (i.e., free radical) reactions. In addition, they are both similar in that both rely on hydrogen peroxide, either as added in the peroxide/oxygen stage or as generated in reaction [6] above in the oxygen stage, to perform a brightening function. It is assumed that organic peroxides (ROOH in equation [8]) generated during oxygen delignification dissociate to form $ROO^-$ nucleophiles that brighten lignin. Accordingly, in both stages (as well as in a peroxide stage), one must be concerned about transition metals undesirably catalyzing free radical reactions.

SUMMARY OF THE INVENTION

The present invention provides a combination of additives and methods for brightening pulps containing less than 18% lignin. The invention can be used in either the peroxide, oxygen, or peroxide/oxygen brightening stages. The additives according to the present invention include an aqueous sodium silicate solution, an alkali agent, and a magnesium compound which dissociates in the solution to form $Mg(OH)^+$ cations. The alkali agent is added in an amount sufficient to maintain a pH of at least about 8, and the magnesium compound is added in an amount to achieve, along with any other dissociated magnesium, an $Mg:SiO_2$ mass ratio of between about 1:46 to about 1:2.

A method for brightening pulp according to the present invention involves mixing pulp containing less than 18% lignin with an aqueous sodium silicate solution, an alkali agent, and a magnesium compound which dissociates in the solution to form $Mg(OH)^+$ cations. The alkali agent and magnesium compound are added to achieve the same pH range and weight ratio mentioned above. The method also includes heating the mixture to allow the mixture to react to cause a portion of the lignin in the pulp to degrade.

According to another embodiment of the present invention directed to the peroxide or peroxide/oxygen brightening stages, a method for brightening pulp containing transition metals, hydrogen peroxide, and less than 18% lignin includes first forming a sodium silicate mixture having a high percentage of high molecular weight silicates. This is accomplished by mixing sodium silicate and a magnesium compound which dissociates in the solution to form $Mg(OH)^+$ cations. This sodium silicate mixture is then added to the pulp to adsorb at least a portion of the transition metals.

The present invention also includes an aqueous composition for use in brightening pulps. The composition includes pulp containing less than 18% lignin, an aqueous sodium silicate solution, an alkali agent, and a magnesium compound which dissociates in the solution to form $Mg(OH)^+$ cations. The alkali agent and magnesium compound are added to achieve the same pH range and weight ratio mentioned above.

It is to be understood that both the foregoing general description and the following detailed description are exemplary, but are not restrictive, of the invention.

DETAILED DESCRIPTION OF THE INVENTION

The present invention is directed to the brightening of certain pulps during peroxide, oxygen, or peroxide/oxygen brightening. As used herein, the term "brightening stage" shall mean either a peroxide stage, an oxygen stage, or a peroxide/oxygen stage. The typical operating conditions and conventional additives to these stages are well known. During such brightening, hydrogen peroxide serves to degrade carbonyl groups of lignin, rendering them more water soluble. In the absence of such degradation, lignin would remain in the pulp, causing the brightness of the pulp to remain lower than would be if such lignin were removed. Transition metals present in the pulp undesirably react with hydrogen peroxide thereby precluding hydrogen peroxide from serving its function of degrading lignin. The present invention is based in part on the recognition that higher molecular weight silicates assist in adsorbing transition metals thus preventing them from undesirably reacting with hydrogen peroxide. The present invention is also based on the recognition that $Mg(OH)^+$ plays a significant role in the molecular weight distribution of a sodium silicate solution. More particularly, the presence of $Mg(OH)^+$ in a sodium silicate solution, over a certain $Mg:SiO_2$ mass ratio, enhances the formation of higher molecular weight silicates.

Accordingly, the present invention is directed to various compositions and methods embodying this concept. The invention provides a combination of additives (either to hydrogen peroxide, oxygen, or a combination thereof, depending on which one of the three brightening stages is being employed) for brightening pulps containing less than 18% lignin. In this case, these additives include an aqueous sodium silicate solution, an alkali agent, and a magnesium compound which dissociates in the solution to form $Mg(OH)^+$ cations. The invention also encompasses an aqueous composition for use in brightening pulps comprising pulp containing less than 18% lignin, hydrogen peroxide (either as an additive or as reacted from reaction [6] above), an aqueous sodium silicate solution, an alkali agent, and a magnesium compound which dissociates in the solution to form $Mg(OH)^+$ cations. The present invention also provides a method for brightening pulp including forming a mixture of the pulp, hydrogen peroxide, aqueous sodium silicate solution, alkali agent, and magnesium compound, then heating the mixture to allow it to react to cause a portion of the lignin to degrade. Finally, the invention is characterized as a method for brightening pulp containing transition metals and less than 18% lignin. This method includes the steps of forming a sodium silicate mixture having a high percentage of high molecular weight silicates by mixing sodium silicate and a suitable magnesium compound, and adding the sodium silicate mixture to the pulp.

The pulp used in connection with the present invention is defined broadly as any pulp having less than 18% lignin (on pulp). Unless otherwise specified, all percentages of lignin include all forms of lignin and are given as weight percentages of the total pulp, on a dry weight basis, so that 18% lignin means that there are 18 grams of lignin in a 100 gram sample of pulp (excluding the weight of water).

Stated another way, the invention can be used with any pulp in which more than 50% of the lignin (by weight, on wood) is removed during pulping. This means that more than half of the original lignin present in the wood is removed during the pulping process. For softwoods, having an average lignin content of 28.6% (by weight, on wood), the removal of half of the original lignin content of the wood during a conventional chemical pulping process results in a pulp having 23.3% lignin (on pulp). For hardwoods, having an average lignin content of 24.1% (by weight, on wood), the removal of half of the original lignin content of the wood during a conventional chemical pulping process results in a pulp having 18.0% lignin (on pulp). The development of these final lignin contents factors in the yield from conventional chemical pulping processes. Thus, any pulp with less than 18% lignin (on pulp) would typically include at least some pulp which was processed by chemical pulping or was derived from a wood having a relatively low initial content of lignin.

In general, chemical pulping processes are continued until the lignin content is reduced to about 5% (on pulp) or less. It is preferable to use the present invention to brighten such pulps. In addition, chemical pulps typically undergo further delignification before the final brightening, stage (i.e., peroxide or peroxide/oxygen) such that the pulps contain about 1–2% lignin before the final brightening stage. Pulps brightened by the present invention can also include such pulps which have been further delignified. The present invention can also be used to brighten pulps having recycled pulps, in which chemical and mechanical pulps are mixed, as long as the average lignin content is less than about 18%. Pulps brightened by the present invention also include semichemical pulps with lignin content varying from approximately 10 to 18%. In Example 4 below, bleached and unbleached samples of de-inked mixed office waste consisting of 65% sorted white ledger and 35% office pack were obtained from a mill in the American Midwest.

The additives of the present invention are used in the peroxide, oxygen, or peroxide/oxygen stages of brightening. The process parameters of these stages are well known. For example, a typical charge of peroxide loading is 20 kg of hydrogen peroxide per metric ton of pulp. The hydrogen peroxide is mixed while the mixture is heated, typically to a temperature of between about 90° C. to about 130° C., often 110° C. Water is also added, typically to achieve a consistency of about 15% solids. Of course, reaction time, temperature, and consistency are all interrelated and can be varied in a known manner. A hydrogen peroxide/oxygen stage is similar to a hydrogen peroxide stage except that the slurry is pressed with oxygen.

An oxygen stage is similar to a hydrogen peroxide/oxygen stage except that no hydrogen peroxide is added. Oxygen delignification is also conducted over a wider consistency range (10% to 35% solids) but 12% to 15% solids is typical. In general, an oxygen stage does not brighten as well as a peroxide stage or as a peroxide/oxygen stage. Oxygen or an oxygen-containing gas (such as air) can be used to pressurize the mixture, and the partial pressure of oxygen typically ranges between 0.38 MPa and 1.48 MPa.

An additive of the present invention is an aqueous sodium silicate solution. Any commercially available aqueous sodium silicate solution may be used, although it is preferable to use as pure of a sodium silicate solution as is practically possible. The sodium silicate solution may be added in an amount to achieve a concentration of from about 0.14% to about 1.4% $SiO_2$ on pulp. Preferably, the sodium silicate solution is added in an amount to achieve a concentration of from about 0.28% to about 1.12% $SiO_2$ on pulp.

Another additive according to the present invention is a magnesium compound which dissociates in the solution to form $Mg(OH)^+$ cations. The magnesium compound should be added in an amount to achieve, along with any other dissociated magnesium, an $Mg:SiO_2$ mass ratio of between about 1:46 to about 1:2. Preferably, the $Mg:SiO_2$ mass ratio is between about 1:15 to about 1:3. Most preferably, the $Mg:SiO_2$ mass ratio is between about 1:10 to about 1:3. The mass ratio is of the total magnesium available for formation into $Mg(OH)^+$, including any of the magnesium added and any magnesium inherent in the pulp and existing in a form which readily dissociates and forms $Mg(OH)^+$ over a pH range of at least 8:

The magnesium compound is added in an amount to achieve an actual concentration of from about 0.01% to about 0.2% Mg on pulp (again including any other source of available magnesium). More preferably, the magnesium compound is added in an amount to achieve a concentration of from about 0.02% to about 0.2% Mg on pulp. Preferably, the magnesium compound is magnesium sulfate, added as $MgSO_4$ or $MgSO_4.7H_2$. Alternatively, the magnesium compound is MgO, $MgCl_2$, $Mg(OH)_2$ and/or $MgNO_3$, among others. Any number of magnesium compounds can be used, as long as they readily form $Mg(OH)^+$ at pH values of at least 8 and are not detrimental to process equipment.

A critical step in the present invention is the formation of the hydrolyzed magnesium cation $Mg(OH)^+$. It is believed that this cation neutralizes dissociated silanol groups and causes silicate polymerization, as summarized by the equations written below:

[9]

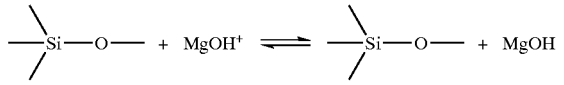

[10]

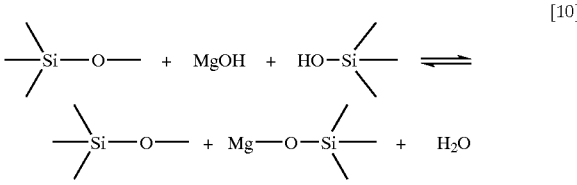

Another additive of the present invention is an alkali agent added in an amount sufficient to maintain a pH of the solution of at least about 8. At pH values of at least about 8, magnesium exists as $Mg(OH)^+$ in an amount sufficient to initiate reaction [9] above. More preferably, the alkali agent is selected and added in an amount sufficient to maintain the pH to a range of between 8 and 12. The alkali agent may be NaOH, $Na_2O$, MgO, $Mg(OH)_2$, $K_2O$, KOH, CaO, and/or $Ca(OH)_2$. Preferably, the non-calcium containing compounds are selected to minimize the formation of silicate scales. Such silicate scales can be detrimental to the quality of the paper product and must be removed periodically resulting in costly stoppages of the process. Because MgO and $Mg(OH)_2$ can serve two functions, namely that as the magnesium compound which readily forms $Mg(OH)^+$ and as an alkali agent, then the magnesium compound and alkali agent can be combined as one additive in some cases.

According to a method of the present invention, the pulp is brightened by mixing the pulp with hydrogen peroxide, an aqueous sodium silicate solution, an alkai agent added in an amount sufficient to maintain the pH of the solution at least about 8, and a magnesium compound which dissociates in the solution to form $Mg(OH)^+$ cations, wherein the magnesium compound is added in an amount to achieve, along with any other dissociated magnesium, an $Mg:SiO_2$ mass ratio of between about 1:15 to about 1:3. This mixture is then heated, which allows the mixture to react to cause a portion of the lignin to degrade (i.e., to break down into a more soluble form to be washed away). In the case where a hydrogen peroxide/oxygen stage is used, the mixture is also pressurized with oxygen, in a known manner. While continuously heated, the chemicals are mixed into the pulp slurry which is retained at an elevated temperature for a period of time sufficient to allow the degradation reactions of the lignin to occur. This typically is between 30 minutes and four hours, depending on the temperature and concentration of the additives in the pulp. Typically, the mixture is heated to a temperature of between about 90° C. and about 130° C.

As mentioned above, the present invention relies on the formation of high molecular weight silicates to adsorb transition metals to avoid the decomposition of hydrogen peroxide by transition metals. Accordingly, the present invention can be characterized as a method for brightening pulp by forming a sodium silicate solution having a high percentage of high molecular weight silicates by mixing sodium silicate and a magnesium compound which dissociates in the solution to form $Mg(OH)^+$ cations. Then, the sodium silicate solution is added to the pulp to adsorb at least a portion of the transition metals of the pulp. Any increased amount of higher molecular weight silicates appears to improve the adsorption of transition metals, but it is preferable that the constituents are added such that the sodium silicate solution has at least 25% of the silicates with a molecular weight of at least 10,000 daltons.

It is not believed that the order of addition is important to the functioning of the present invention. Typically, the magnesium compound is Epsom salt ($MgSO_4.7H_2O$) and is either first dissolved in water or dissolved directly in a commercial aqueous sodium silicate solution. Then the alkali agent(s) is added followed by $H_2O_2$. The combination is then mixed into the pulp slurry.

EXAMPLES

The following examples are included to more clearly demonstrate the overall nature of the invention. These examples are exemplary, not restrictive, of the invention.

Example 1

A kraft pulp was delignified by the ODEop partial sequence and had a kappa number of 2.7 and a viscosity of 19.0 cp. The ODEop partial sequence is called elemental chlorine-free or ECF. The pulp had a low initial Mg content (<50 ppm). The pulp was P/O (P═$H_2O_2$; O═$O_2$) bleached at 12% consistency and 110° C. for 2 hours using reagent grade $H_2O_2$, NaOH and $MgSO_4.7H_2O$. A technical grade sodium silicate solution sold by Fisher Scientific, which contained some transition metals, was used. An $H_2O_2$ charge of 1.5% by weight on pulp was used with 2.0–2.3% NaOH by weight on pulp. The initial $O_2$ pressure for all P/O experiments was 0.38 MPa.

A first series of experiments was run to determine the effect of magnesium sulfate addition on the brightening of this ECF pulp. Table 1 shows both percentage of the constituents in each sample added to the pulp (on a dry weight basis) and the brightness, yield, viscosity, and residual $H_2O_2$. Samples 1 through 4 have the same amount of silicate, sodium hydroxide, and hydrogen peroxide, while the amount of the magnesium compound (in this case, magnesium sulfate) increases from Samples 1 through 4. In all of the tables in the examples, "silicate " refers to the weight percent of a 41 Bésilicate solution (28.7% $SiO_2$) that was added. For all examples, the brightness was determined in accordance with TAPPI Standard T452 om-92. In addition, the pulp yield is the mass of washed pulp from the P or P/O stage divided by the mass of the feed to the stage. The viscosity and residual hydrogen peroxide (given as a percentage of the initial dose) were determined by known methods, including TAPPI Standard T230 om-94 for viscosity and iodometric titration for residual $H_2O_2$.

TABLE 1

Effect of Magnesium Sulfate Application on P/O Bleaching of First ECF Kraft Pulp

| | Sample 1 | Sample 2 | Sample 3 | Sample 4 |
|---|---|---|---|---|
| Silicate, % on pulp | 4.0 | 4.0 | 4.0 | 4.0 |
| NaOH, % on pulp | 2.3 | 2.3 | 2.3 | 2.3 |
| $H_2O_2$, % on pulp | 1.5 | 1.5 | 1.5 | 1.5 |
| $MgSO_4.7H_2O$ % on pulp | 0.0 | 0.25 | 0.5 | 0.75 |
| $SiO_2$, % on pulp | 1.148 | 1.148 | 1.148 | 1.148 |
| Mg, % on pulp | 0.0 | 0.025 | 0.050 | 0.075 |
| $Mg:SiO_2$ mass ratio | 0 | 1:46 | 1:23 | 1:15 |
| End pH | 10.2 | 10.5 | 11.0 | 11.2 |
| Brightness, % | 79.8 | 84.0 | 84.2 | 85.3 |
| Yield, % | 97.2 | 97.7 | 98.1 | 98.2 |
| Viscosity, cp | 8.8 | 11.4 | 13.5 | 14.1 |

TABLE 1-continued

Effect of Magnesium Sulfate Application on P/O Bleaching of First ECF Kraft Pulp

| | Sample 1 | Sample 2 | Sample 3 | Sample 4 |
|---|---|---|---|---|
| Residual $H_2O_2$, % | | | | |
| 30 Minutes | 2 | 25 | 35 | 33 |
| 60 Minutes | 0 | 15 | 22 | 30 |
| 120 Minutes | 0 | 2 | 7 | 10 |

Table 1 shows that an $MgSO_4.7H_2$ charge of 0.25% on pulp (250 ppm Mg on pulp) increased brightness significantly, namely from 79.8% to 84.0%. Also, the brightness increased further when 0.50 and 0.75% $MgSO_47H_2O$ was used. The interesting and totally novel result from Table 1 is the increase in pulp yield caused by the addition of magnesium sulfate. Kraft pulps can be dissolved in a solution of cupriethylenedianine, and the viscosity of the solution is an indicator of the degree of polymerization of the cellulose in the pulp. It can be seen that a higher charge of magnesium sulfate also resulted in higher viscosities (less depolyrnerization of cellulose during $H_2O_2$ brightening). However, the lowest viscosity (no $MgSO_4.7H_2O$) corresponds to an average DP of 815. It is unlikely that cellulose molecules of such high DP would solubilize. Therefore, it appears that hemicelluloses were being dissolved. Most likely, the free radicals from $H_2O_2$ decomposition were causing depolymerization of the hemicellloses to a degree that resulted in their solubilization.

Example 2

A second ECF pulp sample was obtained from the same mill serving as the source of the pulp used in Example 1. It had a kappa number of 2.4 and a viscosity of 20.5 cp. The transition metal content of the first ECF pulp was not measured but the second pulp contained 6 ppm Mn, 8 ppm Fe, and 2 ppm Cu. These values were lowered to 0.3, 3.7 and 1.5 ppm, respectively, after treatment with $Na_5DTPA$. Sample 2 was bleached at 100° C., while Samples 1, 3, and 4 were bleached at 100°. Table 2varies the charge of sodium silicate, with Samples 1 and 2 having no silicate added, while Samples 3 and 4 have a 2.0 and 4.0% charge, respectively.

TABLE 2

Effect of Silicate on P/O Bleaching of Second ECF Kraft Pulp. Chelated Pulp: 0.3 ppm Mn, 3.7 ppm Fe and 1.5 ppm Cu

| | Sample 1 | Sample 2 | Sample 3 | Sample 4 |
|---|---|---|---|---|
| Silicate, % on pulp | 0.0 | 0.0 | 2.0 | 4.0 |
| NaOH, % on pulp | 2.0 | 2.0 | 2.0 | 2.0 |
| $H_2O_2$, % on pulp | 1.5 | 1.5 | 1.5 | 1.5 |
| $MgSO_4.7H_2O$ % on pulp | 0.5 | 0.5 | 1.0 | 0.5 |
| $SiO_2$, % on pulp | 0.0 | 0.0 | 0.574 | 1.148 |
| Mg, % on pulp | 0.05 | 0.05 | 0.10 | 0.05 |
| Mg:$SiO_2$ mass ratio | NA* | NA* | 1:6 | 1:23 |
| End pH | 10.9 | 10.9 | 10.5 | 10.9 |
| Brightness, % | 85.1 | 84.3 | 85.7 | 85.3 |
| Yield, % | 98.0 | 98.3 | 98.2 | 98.6 |
| Viscosity, cp | 12.6 | 13.7 | 16.3 | 13.7 |
| Residual $H_2O_2$, % | | | | |
| 30 Minutes | 24.9 | 31.5 | 38.2 | 41.5 |
| 60 Minutes | 10.0 | 19.9 | 28.2 | 31.5 |
| 120 Minutes | 3.3 | 6.6 | 14.9 | 14.9 |

*Not applicable

Table 2 shows slight increases in brightness and yield of the chelated sample when the amount of sodium silicate is increased. The low transition metal contents of this pulp, particularly the 0.3 ppm Mn, can be achieved in only a few commercial installations. More significantly, the presence of sodium silicate shows a significant increase in residual hydrogen peroxide, which is important in maintaining brightness. In the absence of silicate, the $H_2O_2$ residual for most pulp samples would be zero after two hours at 110° C.

Example 3

Four more samples of the same ECF pulp used in Example 2, having a kappa number of 2.4 and a viscosity of 20.5 cp, were tested. In this case, the pulp was unchelated. In Samples 1 and 2 below, the temperature of the stage was 90° C. while the temperature of Samples 3 and 4 was 110° C. Samples 1 and 3 contained no silicate, while Samples 2 and 4 did.

TABLE 3

Effect of Temperature on P/O Bleaching of Second ECF Kraft Pulp. Unchelated Pulp: 6 ppm Mn, 8 ppm Fe and 2 ppm Cu

| | Sample 1 | Sample 2 | Sample 3 | Sample 4 |
|---|---|---|---|---|
| Temperature, ° C. | 90 | 90 | 110 | 110 |
| Silicate, % on pulp | 0 | 2.0 | 0 | 2.0 |
| NaOH, % on pulp | 2.0 | 2.0 | 2.0 | 2.0 |
| $H_2O_2$, % on pulp | 1.5 | 1.5 | 1.5 | 1.5 |
| $MgSO_4.7H_2O$ % on pulp | 0.5 | 1.0 | 0.5 | 1.0 |
| $SiO_2$, % on pulp | 0.0 | 0.574 | 0.0 | 0.574 |
| Mg, % on pulp | 0.05 | 0.1 | 0.05 | 0.1 |
| Mg:$SiO_2$ mass ratio | NA | 1:6 | NA | 1:6 |
| End pH | 11.3 | 11.6 | 9.9 | 10.9 |
| Brightness, % | 78.0 | 79.9 | 79.7 | 81.8 |
| Yield, % | 98.5 | 98.7 | 97.9 | 98.5 |
| Viscosity, cp | 15.4 | 15.7 | 11.5 | 14.1 |
| Residual $H_2O_2$, % | | | | |
| 30 Minutes | 3.3 | 18.2 | 1.7 | 10.0 |
| 60 Minutes | 1.7 | 10.0 | 0.0 | 5.0 |
| 120 Minutes | 0.0 | 5.0 | 0.0 | 3.3 |

Table 3 shows that, at either temperature, the inclusion of sodium silicate improves the brightening process. At 90° C., a sample having sodium silicate gave no noticeable improvement in yield but 1.9% increase in brightness. At 110° C., a sample including sodium silicate caused a 0.6% increase in yield and a 2.1% increase in brightness. Also, as before, the presence of sodium silicate showed a significant increase in residual hydrogen peroxide, which is important in maintaining brightness.

Example 4

Bleached and unbleached samples of de-inked, mixed office waste (MOW) consisting of 65% sorted white ledger and 35% office pack were obtained from a mill in the American Midwest. This pulp sample was from almost exclusively chemical pulps. The properties of the samples are summarized in Table 4. High positive b* value indicates a yellowish tint and a high negative value indicates a bluish tint. A high positive a* value indicates a reddish tint and a high negative value-indicates a greenish tint. The aim of bleaching is to decrease the absolute a* and b* values to as close to zero and increase the L* value as high as possible.

As shown in Table 4, the effect of the addition of silicate and magnesium sulfate to MOW was determined.

TABLE 4

Effect of Silicate Addition on P/O Bleaching of Mixed Office Waste (MOW)

| Pulp[1] | MOW | MOW | BL. MOW | BL. MOW |
|---|---|---|---|---|
| Silicate, % on pulp | 0.0 | 4.0 | 0.0 | 4.0 |
| NaOH, % on pulp | 2.3 | 2.3 | 2.3 | 2.3 |
| $H_2O_2$, % on pulp | 1.5 | 1.5 | 1.5 | 1.5 |
| $MgSO_4.7H_2O$ on pulp | 0.5 | 0.5 | 0.5 | 0.5 |
| $SiO_2$, % on pulp | 0.0 | 1.148 | 0.0 | 1.148 |
| Mg, % on pulp | 0.05 | 0.05 | 0.05 | 0.05 |
| Mg:$SiO_2$ mass ratio | NA | 1:23 | NA | 1:23 |
| End pH | 10.1 | 10.2 | 10.0 | 10.0 |
| Brightness, % | 77.9 | 80.4 | 85.4 | 88.3 |
| L* | 91.51 | 91.86 | 94.79 | 95.24 |
| a* | −0.46 | 0.22 | 0.27 | −0.07 |
| b* | 1.67 | 0.73 | 1.68 | 0.48 |
| Yield, % | 95.4 | 96.5 | 97.3 | 97.4 |
| Viscosity, cp | 9.8 | 11.0 | 9.7 | 11.1 |
| Residual $H_2O_2$, % of Applied | | | | |
| 30 Minutes | 2 | 27 | 3 | 28 |
| 60 Minutes | 0 | 10 | 1 | 15 |
| 120 Minutes | 0 | 5 | 0 | 7 |

[1]Mixed office waste (MOW) pretreated with 0.2% DTPA: Brightness, 74.2; L* = 89.78; a* = 0.76; b* = 1.77. Commercially bleached mixed office waste (BLMOW) pretreated with 0.2% DTPA: Brightness, 83.6, L* = 94.4; a* = 0.28; b* = 1.72.

It can be seen (footnotes of Table 4) that $H_2O_2$ bleaching in the mill (~1.0% $H_2O_2$, ~95° C.) did not significantly lower the b* value. Both the unbleached and commercially bleached samples were treated with $Na_5DTPA$ then brightened with 1.5% $H_2O_2$ at 110° C. For the unbleached sample, the inclusion of 4.0% silicate resulted in an improvement of 2.5 brightness points. The a* and b* values were closer to zero as well. Similar benefits were obtained when the commercially bleached pulp was brightened further. Without silicate, no significant decrease in b* was obtained. A high temperature and high $H_2O_2$ residuals apparently are required to destroy the colored contaminants responsible for the b* value. The inclusion of silicate increased the yield of the unbleached pulp by 1.1%.

Example 5

The results in Table 1 showed increased brightness with an increase in the dose ratio of $MgSO_4.7H_2O$:sodium silicate (41 Bé). The dose ratio was increased further in Table 2 where 2% sodium silicate and 1.0% $MgSO_4.7H_2O$ on pulp were used (i.e., Sample 3 of Table 2), which resulted in the highest brightness (85.7%) for the ECF pulps. In this Example, the effect of dose ratio on the brightening of a totally chlorine-free (TCF) pulp is investigated.

The TCF pulp (kraft) was from a Swedish mill and it had a kappa number of 7.4 and a viscosity of 23.4 cp. It also contained 1.9 ppm Mn, 4.7 ppm Fe, and 0.8 ppm Cu. After it was acid-washed it contained 0.1 ppm Mn, 4.0 ppm Fe, and 0.8 ppm Cu. The acid-washed pulp was brightened with various dose ratios of $MgSO_47H_2O$:sodium silicate. The $H_2O_2$ and NaOH charges were 2.0% and 2.5% on pulp, respectively, and the pulps were brightened for two hours at 110° C. and 12% consistency.

TABLE 5

Effect of Silicate and $MgSO_4.7H_2O$ on P/O Bleaching of Acid-Washed TCF Pulps

| | Sample 1 | Sample 2 | Sample 3 | Sample 4 |
|---|---|---|---|---|
| Silicate, % on pulp | 0 | 4.0 | 2.0 | 1.0 |
| NaOH, % on pulp | 2.5 | 2.5 | 2.5 | 2.50 |
| $H_2O_2$, % on pulp | 2.0 | 2.0 | 2.0 | 2.0 |
| $MgSO_4.7H_2O$ % on pulp | 0.5 | 0.5 | 1.0 | 1.0 |
| $SiO_2$, % on pulp | 0 | 1.148 | 0.574 | 0.287 |
| Mg, % on pulp | 0.05 | 0.05 | 0.10 | 0.10 |
| Mg:$SiO_2$ mass ratio | NA | 1:23 | 1:6 | 1:3 |
| End pH | 10.5 | 11.3 | 10.9 | 10.8 |
| Brightness, % | 75.4 | 78.2 | 79.4 | 77.9 |
| Yield, % | 96.3 | 98.2 | 98.3 | 98.0 |
| Viscosity, cp | 9.1 | 13.1 | 15.5 | 12.8 |
| Residual $H_2O_2$, % | | | | |
| 30 Minutes | 15 | 32 | 37 | 31 |
| 60 Minutes | 4 | 19 | 16 | 8 |
| 120 Minutes | 0 | 5 | 5 | 1 |

The brightness and yield were relatively low when silicate was excluded (Sample 1 of Table 5). The highest brightness was obtained with $MgSO_4.7H_2O$:sodium silicate dose ratio of 1%:2%. The next highest brightness was for dose ratio 0.5%:4%, followed by 1%:1%.

A general trend from the first five tables is that, for a given temperature, higher brightness and yields are obtained as $H_2O_2$ stabilization is improved (higher residuals). There is not an exact correlation because, for these experiments, the accuracy on $H_2O_2$ residual was about ±5% of the initial charge. However, final brightness in Table 5 correlates with $H_2O_2$ residual after 30 minutes.

The three dose ratios in Table 5, i.e. 0.5:4.0; 1.0:2.0; and 1.0;1.0, were used in a pulp-free system to deactivate 1 ppm, each $Mn^{2+}$, $Fe^{3+}$, and $Cu^{2+}$ added simultaneously to the alkaline solution. For each dose ratio, the initial solution phase concentrations of $H_2O_2$, $MgSO_4.7H_2O$, and sodium silicate were identical to when pulp was present. In the absence of pulp, less NaOH was required to achieve pH 11.2 taken as a rough average for P/O bleaching. The solutions were retained at 110° C. for two hours then cooled and ultra-filtration was used to separate high and low molecular weight silicates. Membranes with 10,000 MW cutoff were used.

The results will be analyzed in terms of ppm Si in solution, The 41 Bé silicate solution that was used contained 28.7% $SiO_2$. Therefore 4% silicate on pulp corresponds to 1.148 $SiO_2$ on pulp or 0.536% Si on pulp. One hundred grams of pulp at 12% consistency is associated with 733 mL of solution (assuming a specific gravity of 1.0). Therefore, the Si concentration is 0.536 g in 733 mL or 0.731 g/L (~730 ppm). The solutions passing through the membrane were analyzed for Si, Mn, Fe and Cu concentrations by ICP spectroscopy. The results are presented in Table 6.

TABLE 6

| | Conc. Passing Through Membrane | | | |
|---|---|---|---|---|
| Mg and Silicate Conc., ppm in Solution | Si | Mn | Fe | Cu |
| 68 ppm Mg* + 730 ppm Si | 617 | 0.008 | 0.023 | 0.027 |
| 136 ppm Mg + 365 ppm Si | 194 | 0.001 | 0.001 | 0.016 |
| 136 ppm Mg + 183 ppm Si | 56 | 0.004 | 0.001 | 0.018 |

*0.5% $MgSO_4 \cdot 7H_2O$ on pulp

Table 6 shows that in the case of 0.5% $MgSO_4.7H_2O$ and 4% silicate, 85%o of the Si passes through the membrane as low molecular weight compounds. However, less than 3% of the Fe and Cu and less than 1% of the Mn pass through. The transition metals appear to be bound to the high molecular weight silicate retained on the membrane. The data would suggest that 1.0% $MgSO_4.7H_2O$ and 2.0% silicate give the best transition metal deactivation, particularly of Mn which is believed to be the most aggressive catalyst for $H_2O_2$ decomposition. The significance of the differences between 1, 4, and 8 ppb Mn or 16, 18 and 27 ppb Cu in solution might be deemed insignificant. However, there is no doubt that it is the high molecular weight silicate that adsorbs or complexes the transition metals. The amount of high molecular weight silicate (greater than 10,000 daltons) for the various formulations are 113 ppm Si for 0.5%:4.0%; 127 ppm for 1.0%:1.0%; and 171 ppm for 1.0%:2.0%. The clear superiority of the 1%:2.0% formulation in Table 6 is now evident.

Example 6

The ECF pulp of Example 1 used for peroxide/oxygen bleaching was treated with an acidic chlorine dioxide stage while the TCF pulp was acid-washed. Calcium that was bound to the pulps dissolved in the acidic solutions and was washed out. Six effluents from peroxide/oxygen bleaching of ECF pulps and five effluents from TCF pulps were collected and divided in two. Calcium chloride was added to one half of each effluent to give a concentration of 50 ppm $Ca^{2+}$ in solution. Smaller volumes of the straight and calcium-enriched effluents were adjusted to pH values of 9.0 and 10.0, than one inch square strips of 20-mesh stainless steel were placed in each solution or slurry. All of the selected effluents contained both epsom salt and sodium silicate. There was no magnesium silicate precipitate at either pH value, but there were calcium-magnesium silicate precipitates in most of the eleven effluents that were enriched with calcium chloride.

Each metal strip weighed about 1.6 grams initially and, surprisingly, none of them gained any weight when placed in any of the magnesium silicate solutions or the calcium-magnesium silicate slurries for more than 96 hours at room temperature (about 20° C.). When taken from the solution or slurry, each strip weighed within 2 milligrams of its initial weight after washing and air-drying. This confirms that calcium silicates adhere to metals while calcium-magnesium and magnesium silicates do not.

Unbleached pulps are normally not acid-washed or treated with chelating-agents before $O_2$ delignification. Therefore, pulps normally enter an oxygen delignification stage with higher concentrations of calcium than that of pulps entering a peroxide/oxygen stage. However, if 1% epsom salt and 2% sodium silicate is added, there would be enough magnesium cations to chemisorb most of the dissociated silanol groups at pH values less than 11. Since magnesium cations are preferentially chemisorbed over calcium cations, any potential precipitate would be rich in magnesium. It is unlikely that such precipitates would scale the oxygen washers, where the pulp is washed after oxygen delignification. Scaling is unlikely at the high pH values of the black liquor (i.e., washed liquor from the unbleached pulp) evaporators, which are used to evaporate moisture after washing and before burning the now concentrated black liquor in a kraft recovery furnace. The likely scenario is that the calcium-magnesium silicate will pass through the kraft recovery furnace and be removed with the dregs at the green liquor clarifier. (Green liquor is the viscous fluid removed from the bottom of the recovery furnace and is made up primarily of inorganic compounds, such as sodium sulfide and sodium carbonate.) After removal, green liquor is diluted and insoluble materials (i.e., dregs) are separated by sedimentation. A high rate of sedimentation is observed for these calcium-magnesium silicate particles.

The effect of the magnesium sulfate/sodium silicate combination on oxygen delignification is demonstrated below in Table 7. Two-stage oxygen delignification of a 41 kappa number kraft pulp was simulated by adding 2% NaOH on pulp and 0.72 MPa of oxygen at 12% consistency and 90° C. for 30 minutes, followed by a second NaOH injection (1.0% NaOH on pulp), restoration of oxygen pressure, and 30 minutes of additional retention. The standard oxygen included 0.5% epsom salt on pulp added during the preheat stage, i.e., before all other chemicals. When silicate was used, 1% Epsom salt on pulp was added at the preheat stage and 2% sodium silicate was added along with the first sodium hydroxide injection. Silicate additions significantly improved delignification selectivity (kappa number versus;viscosity). Pulp brightness is also increased.

TABLE 7

Effect of Silicate Addition on Kappa Number and Viscosity After $O_2$ Delignification

| | Standard Oxygen | $O_2$ with Silicate |
|---|---|---|
| MgSO4 $7H_2O$, % on pulp | 0.5 | 1.0 |
| Silicate, % on pulp | 0 | 2.0 |
| end pH | 11.0 | 11.6 |
| Brightness, % | 28.2 | 30.8 |
| Kappa No. | 20.4 | 20.0 |
| Viscosity, cP | 21.2 | 24.7 |

[1]Laboratory pulp made from 5 kg of chips, kappa number 41, viscosity 35 cP and screened yield of 47.8%

The improvement in viscosity is significant because viscosity is lowered further by most delignification and brightening stages, including P/O stages. If the viscosity is lowered below 10–12 cP (DP~1000) then the strength values of paper made from the pulp decline dramatically.

Although illustrated and described herein with reference to certain specific embodiments and examples, the present invention is nevertheless not intended to be limited to the details shown. Rather, the claims should be read to include various modifications within the scope and range of equivalents of the claims, without departing from the spirit of the invention.

What is claimed is:

1. A method for brightening a chemical pulp comprising the steps of:

mixing pulp containing less than 18% lignin with hydrogen peroxide, an aqueous solution or sodium silicate, wherein sodium silicate comprises sodium oxide ($Na_2O$) and silica·($SiO_2$); an alkali agent added in an amount sufficient to maintain the pH of said solution at least about 8; and a magnesium compound which dissociates in said solution to form Mg(OH)— cations, wherein said magnesium compound is added in an amount to achieve, along with any other dissociated magnesium, an Mg:$SiO_2$ mass ratio of between about 1:10 to about 1:3, to form a mixture, and wherein at least 25% of the $SiO_2$ has a molecular weight of at least 10,000 Daltons;

pressurizing said mixture with an oxygen-containing gas; and heating said mixture to allow said mixture to react to cause a portion of said lignin to degrade.

2. A method in accordance with claim 1 wherein the oxygen partial pressure is in the range of between about 0.38 to about 1.48 MPa.

* * * * *